US007015186B2

(12) United States Patent
Aussant et al.

(10) Patent No.: US 7,015,186 B2
(45) Date of Patent: Mar. 21, 2006

(54) PERFUME COMPOSITION

(75) Inventors: Emmanuel Julien Aussant, Vlaardingen (NL); Vidyadhar Sudhir Ranade, Vlaardingen (NL)

(73) Assignee: Unilever Home & Personal Care USA a division of Conopco, Inc., Greenwich, CT (US)

( * ) Notice: Subject to any disclaimer, the term of this patent is extended or adjusted under 35 U.S.C. 154(b) by 71 days.

(21) Appl. No.: 10/603,319

(22) Filed: Jun. 25, 2003

(65) Prior Publication Data

US 2005/0101501 A1 May 12, 2005

(30) Foreign Application Priority Data

Jun. 27, 2002 (EP) ..... 02077588

(51) Int. Cl.
*C11D 17/04* (2006.01)
*C11D 3/50* (2006.01)
*D06L 1/12* (2006.01)

(52) U.S. Cl. ..... 510/439; 510/296; 8/137; 134/42

(58) Field of Classification Search ..... 510/439, 510/296; 8/137; 134/42
See application file for complete search history.

(56) References Cited

U.S. PATENT DOCUMENTS

| | | | | |
|---|---|---|---|---|
| 3,449,266 | A * | 6/1969 | Cashman et al. | 512/2 |
| 3,576,760 | A | 4/1971 | Gould et al. | |
| 4,020,156 | A * | 4/1977 | Murray et al. | 424/76.6 |
| 4,152,272 | A | 5/1979 | Young | |
| 4,209,417 | A | 6/1980 | Whyte | |
| 4,339,356 | A | 7/1982 | Whyte | |
| 4,402,856 | A | 9/1983 | Schnoring et al. | |
| 4,974,725 | A * | 12/1990 | Ishihara et al. | |
| 5,066,419 | A | 11/1991 | Walley et al. | |
| 5,094,761 | A | 3/1992 | Trinh et al. | |
| 5,336,665 | A | 8/1994 | Garner-Gray et al. | |
| 5,858,959 | A | 1/1999 | Surutzidis et al. | |
| 6,194,375 | B1 * | 2/2001 | Ness et al. | 512/4 |
| 6,495,504 | B1 | 12/2002 | Schramm, Jr. et al. | 510/296 |
| 6,498,135 | B1 * | 12/2002 | Angell et al. | 510/441 |
| 6,727,215 | B1 * | 4/2004 | Roberts et al. | 510/296 |
| 6,846,795 | B1 * | 1/2005 | Lant et al. | 510/446 |
| 2002/0035049 | A1 * | 3/2002 | Suri et al. | 510/191 |
| 2002/0077264 | A1 * | 6/2002 | Roberts et al. | 510/296 |
| 2002/0123444 | A1 * | 9/2002 | Fisher et al. | 510/297 |
| 2003/0199412 | A1 * | 10/2003 | Gupta et al. | 510/285 |

FOREIGN PATENT DOCUMENTS

| | | | |
|---|---|---|---|
| DE | 199 45 849 | A1 | 3/2001 |
| EP | 0 391 087 | A1 | 10/1990 |
| EP | 0 535 942 | | 4/1993 |
| EP | 0 536 942 | | 4/1993 |
| EP | 0 469 228 | | 5/1996 |
| EP | 0 879 874 | | 11/1998 |
| FR | 2 351 869 | | 1/1978 |
| GB | 2 066 839 | | 7/1981 |
| GB | 2 090 278 | | 7/1982 |
| JP | 58103599 | * | 6/1983 |
| JP | 62223111 | * | 10/1987 |
| JP | 05168686 | * | 7/1993 |
| WO | 94/28107 | | 12/1994 |
| WO | 96/21719 | | 7/1996 |
| WO | 97/11152 | | 3/1997 |
| WO | 97/34982 | | 9/1997 |
| WO | 98/41607 | | 9/1998 |
| WO | 01/85892 | A1 | 11/2001 |
| WO | 02/102958 | A1 | 12/2002 |

* cited by examiner

*Primary Examiner*—Lorna M. Douyon
(74) *Attorney, Agent, or Firm*—Alan A. Bornstein

(57) ABSTRACT

A pouch comprising perfume particles.

7 Claims, No Drawings

PERFUME COMPOSITION

FIELD OF THE INVENTION

The present invention relates to the delivery of perfume, particularly to the delivery of perfume particles in applications such as for cleaning and treating laundry, kitchen, skin or hair surfaces.

BACKGROUND OF THE INVENTION

Most consumers have come to expect scented laundry products and to expect that fabrics which have been laundered also have a pleasing fragrance. Perfume additives make laundry compositions more aesthetically pleasing to the consumer, and in some cases the perfume imparts a pleasant fragrance to fabrics treated therewith. However, the amount of perfume carryover from an aqueous laundry bath onto fabrics is often marginal. Industry, therefore, has long searched for an effective perfume delivery system for use in detergent products which provides long-lasting, storage-stable fragrance to the product, as well as releases fragrance during use to mask wet solution odor and delivers fragrance to the laundered fabrics.

It is known that deposition of fragrance on to surfaces to be cleaned can be greatly enhanced by using fragrance particles. These particles also cue cleanliness for a longer time because they slowly release perfume after cleaning (EP469228). Such particles are made either by supporting the fragrance on a porous carrier or by encapsulating the fragrance in a shell. To some extent the storage stability of fragrances is also improved by using fragrance particles (e.g. WO9621719, U.S. Pat. No. 5,858,959 and WO9711152). Further improvements have been reported by coating such particles (e.g., GB2090278, EP0879874). Nevertheless, in practice the use of such particles have never been satisfactory.

There has been a continuing search for methods and compositions which will effectively and efficiently deliver perfume from a laundry bath onto fabric surfaces. As can be seen from the following disclosures, various methods of perfume delivery have been developed involving protection of the perfume through the wash cycle, with release of the perfume onto fabrics. U.S. Pat. No. 4,402,856, Schnoring et al, issued Sep. 6, 1983, teaches a microencapsulation technique which involves the formulation of a shell material which will allow for diffusion of perfume out of the capsule only at certain temperatures. U.S. Pat. No. 4,152,272, Young, issued May 1, 1979, teaches incorporating perfume into waxy particles to protect the perfume through storage in dry compositions and through the laundry process. The perfume assertedly diffuses through the wax on the fabric in the dryer. U.S. Pat. No. 5,066,419, Walley et al, issued Nov. 19, 1991, teaches perfume dispersed with a water-insoluble nonpolymeric carrier material and encapsulated in a protective shell by coating with a water-insoluble friable coating material. U.S. Pat. No. 5,094,761, Trinh et al, issued Mar. 10, 1992, teaches a perfume/cyclodextrin complex protected by clay which provides perfume benefits to at least partially wetted fabrics.

Another method for delivery of perfume in the wash cycle involves combining the perfume with an emulsifier and water-soluble polymer, forming the mixture into particles, and adding them to a laundry composition, as is described in U.S. Pat. No. 4,209,417, Whyte, issued Jun. 24, 1980; U.S. Pat. No. 4,339,356, Whyte, issued Jul. 13, 1982; and U.S. Pat. No. 3,576,760, Gould et al, issued Apr. 27, 1971.

The perfume can also be adsorbed onto a porous carrier material, such as a polymeric material, as described in U.K. Pat. Pub. 2,066,839, Bares et al, published Jul. 15, 1981. Perfumes have also been adsorbed onto a clay or zeolite material which is then admixed into particulate detergent compositions. Generally, the preferred zeolites have been Type A or 4A Zeolites with a nominal pore size of approximately 4 Angstrom units. It is now believed that with Zeolite A or 4A, the perfume is adsorbed onto the zeolite surface with relatively little of the perfume actually absorbing into the zeolite pores. While the adsorption of perfume onto zeolite or polymeric carriers may provide some improvement over the addition of neat perfume admixed with detergent compositions, industry is still searching for improvements in the length of storage time of the laundry compositions without loss of perfume characteristics, in the intensity or amount of fragrance released during the wash process and delivered to fabrics, and in the duration of the perfume scent on the treated fabric surfaces.

Combinations of perfumes generally with larger pore size zeolites X and Y are also taught in the art. These earlier teachings are referred to in the more recently filed European applications Publication No. 535,942, published Apr. 7, 1993, and Publication No. 536,942, published Apr. 14, 1993, by Unilever PLC, and U.S. Pat. No. 5,336,665, issued Aug. 9, 1994 to Garner-Gray et al. Effective perfume delivery compositions are taught by WO 94/28107, published Dec. 8, 1994 by The Procter & Gamble Company. These compositions comprise zeolites having pore size of at least 6 Angstroms (e.g., Zeolite X or Y), perfume releaseably incorporated in the pores of the zeolite, and a matrix coated on the perfumed zeolite, the matrix comprising a water-soluble (wash removable) composition comprising from 0% to about 80%, by weight, of at least one solid polyol containing more than 3 hydroxyl moieties and from about 20% to about 100%, by weight, of a fluid diol or polyol, in which the perfume is substantially insoluble and in which the solid polyol is substantially soluble.

Other perfume delivery systems are taught by WO 97/34982 and WO 98/41607, published by The Procter & Gamble. WO 97/34982 discloses particles comprising perfume loaded zeolite and a release barrier, which is an agent derived from a wax and having a size (i.e., a cross-sectional area) larger than the size of the pore openings of the zeolite carrier. WO 98/41607 discloses glassy particles comprising agents useful for laundry or cleaning compositions and a glass derived from one or more of at least partially-water-soluble hydroxylic compounds. A preferred agent is a perfume in a zeolite carrier. DE-A-199 45 849 discloses a two layered tablet with 4 wt. % of perfume particles packaged in water-insoluble polypropylene.

However, even with the substantial work done by industry in this area, a need still exists for a simple, more efficient and effective perfume delivery system which can be used in a variety of cleaning and treatment compositions to provide initial and lasting perfume benefits to surfaces such as fabrics which have been treated with the laundry product. In addition, consumer trend to seek more practical methods of providing a perfume benefit to different surfaces. The prior art methods usually rely on complicated process steps of multiple layers or coating to function as a barrier thereby increasing the cost and complexity of the supply chain. Even then storage stability of the perfume particles is often unsatisfactory. Another problem that may occur in providing perfumed products is the excessive odor intensity associated with the products. A need therefore exists for a perfume delivery system which overcomes one or more of the above mentioned drawbacks.

By the present invention it has now been discovered that perfume loaded in and/or on to carriers can be effectively protected from premature release of perfume by enclosing said loaded carrier particles into a pouch of water-reactive material. The carrier may be porous and may be selected to be substantive to fabrics to be able to deposit enough perfume on the fabrics to deliver a noticeable odor benefit even after the fabrics are dry.

The present invention solves the long-standing need for a simple, effective, storage-stable perfume delivery system which provides consumer-noticeable odor benefits during and after the laundering process, and which has reduced product odor during storage of the composition. The present invention also provides for a simple and practical way of providing a perfume benefit to house hold surfaces separate from a cleaning composition. In particular, fabrics treated by the present perfume delivery system have higher scent intensity and remain scented for longer periods of time after laundering and drying.

SUMMARY OF THE INVENTION

The present invention relates to the delivery of perfume particles, which may be incorporated in a variety of consumer products, including cleaning/care compositions for variety of surfaces (laundry, kitchen, dishes, skin, hair), room deodorizers, insecticidal compositions, carpet cleaners and deodorizers wherein the perfume is protected from release until exposed to a wet or moist environment. Specifically, the present perfume delivery system is according to claim 1. The present delivery system is preferably used to deliver perfume agents during a laundering process in the wash cycle or rinse cycle.

In traditional perfume delivery systems most of the perfume material is "lost" due to diffusion of the volatile perfume materials from the product during storage and later by dissolution in the wash, and is not delivered to the fabric surface. In the present invention, the pouch effectively entraps the perfume material loaded into the carrier core. Thus, the perfume material is delivered to the fabric surface at a higher rate through the wash than with traditional perfume delivery systems.

The protective pouch enables it to withstand the relatively harsh environment of other cleaning agents. The pouch can be made of any size so as to tailor it to a certain application and a dose level.

Accordingly, it is an object of the present invention to provide a pouch according to claim 1. Another embodiment of the present invention provides method for improving the storage stability of perfume particles. Still another embodiment of the present invention provides a method for depositing perfume onto a surface, preferably a fabric surface. These and other objects, features and advantages of the present invention will be recognizable to one of ordinary skill in the art from the following description and the appended claims.

DETAILED DESCRIPTION OF THE PREFERRED EMBODIMENTS

The present invention relates to a pouch made of water-reactive material comprising solids wherein more than 10% by weight of the total amount of solids in the pouch are perfume particles, preferably more than 25%, more preferably more than 50%, most preferably more than 90%.

According to another aspect of the invention a method is provided for improving the storage stability of perfume particles comprising the steps of forming a pouch of a water-reactive film in an open form, adding multiple perfume particles into said pouch, sealing said pouch to close it.

According to yet another aspect of the invention a method is provided for depositing perfume onto a surface (preferably fabrics) comprising contacting the pouch comprising perfume particles with an aqueous solution whereby the perfume particles are released into the solution thereby forming a wash liquor and contacting the surface with the thus formed wash liquor comprising preferably at least about 0.1 ppm of the perfume particle.

The pouch may be used in combination with laundry and cleaning compositions including traditional granular and liquid laundry detergents as well as granular and liquid bleach, automatic dishwashing, kitchen surface cleaning, fabric softening compositions and personal care compositions. Liquid detergents is meant to include gel, paste like product formats. The pouched perfume particles of the present invention provides superior through the wash perfume delivery capabilities and/or as minimizes intense product odor due to evolving volatile perfume ingredients. The inventive perfume delivery is also cost effective, simple and efficient compared to the prior art coating and encapsulation techniques. Preferably pouch is meant to encompass capsules. The perfume particles in the pouch are preferably free flowing particles to facilitate the preparation thereof. Preferably, the pouch has a total surface area of at least 0.5 $cm^2$, preferably at least 1 $cm^2$ preferably at least 2 $cm^2$ and at most 800 $cm^2$, preferably at most 600 $cm^2$ most preferably at most 200 $cm^2$.

Particle Carrier Material

The perfume particle comprises particle carrier material and perfume. The particle material may be selected from encapsulation, swellable or porous carrier material.

The particle carrier material, as used herein, means any material capable of supporting (e.g., by absorption or adsorption into and/or onto the pores/surfaces) holding or encapsulating a perfume. Such materials include inorganic porous solids such as zeolites and silica and organic swellable polymers or encapsulation materials such as those based on a polymer. A pouch according to the invention may comprise perfume particles of different particle carrier materials.

The particle carrier material is typically selected from silicas, zeolites, macroporous zeolites, amorphous silicates, crystalline nonlayer silicates, layer silicates, calcium carbonates, calcium/sodium carbonate double salts, sodium carbonates, clays, sodalites, alkali metal phosphates, pectin, chitin microbeads, carboxyalkylcelluloses, gums, resins, gelatin, gum arabic, porous starches, modified starches, carboxyalkyl starches, cyclodextrins, maltodextrins, synthetic polymers such as polyvinyl pyrrolidone (PVP), polyvinyl alcohol (PVA), cellulose ethers, polystyrene, polyacrylates, polymethacrylates, polyolefins, aminoplast polymers, crosslinkers and mixtures thereof. For the purpose of this invention polymers include co-polymers made from 2 or more different co-monomers.

According to one preferred embodiment, the perfume particles in the pouch comprise particles of swellable core material The swellable core material is typically, and preferably, non-porous and is suitably an organic polymer.

Preferably, the organic polymer produced by polymerisation results in a solid core, rather than a hollow capsule. Advantageously, formation of a solid core enables access to the desired size range of particles, and the polymerisation reaction may be carried out in the absence of perfume.

Suitable organic polymers useful herein are polymers of a vinyl monomer which may be cross-linked or partially cross-linked. It is also possible to use simple linear polymers, however, these can give cores which may lack structural integrity so may dissolve when added to a perfume, or at least be somewhat sticky. Thus, it is usually convenient and preferred to introduce some cross-linking or chain branching.

Therefore, suitable organic polymers useful herein may be formed by polymerisation of vinyl monomers, with some cross-linking and/or chain branching agent included in the monomers which are polymerised, so that some cross-links are formed between the polymer chains. If a cross-linking agent is used, the proportion of cross-linking may be low, so that after polymerisation there may be some polymer chains which remain entirely linear and are not cross-linked to any other chains.

A number of vinyl monomers containing a single carbon-carbon double bond may be used. One suitable category of monomers (A) are esters of acrylic and alkyl acrylic acids of formula:

$H_2C{=}CR^1CO_2R^2$ where $R^1$ is hydrogen or straight or branched alkyl of 1 to 6 carbon atoms, preferably 1 to 3 carbon atoms and $R^2$ is straight or branched alkyl of 1 to 8 carbon atoms, preferably 3 to 6 and most preferably 3 or 4 carbon atoms in a straight or branched chain.

These monomers may be used either singly, or in the form mixtures such as a combination of two or more monomers. Specific examples of suitable monomers are isobutyl methacrylate (which is particularly preferred), n-butyl acrylate, n-butyl methacrylate, isobutyl acrylate, n-propyl acrylate and iso-propylmethacrylate. Less preferred is methyl methacrylate. Another suitable monomer is styrene.

Cross-linking between polymer chains formed from the above monomers can be achieved by including in the monomer mixture a small proportion—for example less than 10%, preferably as little as 5% or 1% by weight of the mixture—of a monomer having at least two carbon-carbon double bonds. The use of such a material to provide cross-linking is well known in other applications of polymers, although it is usual to introduce a greater proportion of crosslinking than is required for this invention. Examples of this type of cross-linking agent are divinyl benzene, diesters formed between acrylic acid and diols, such as 1,4-butane diol diacrylate, and higher esters formed between acrylic acid and polyols—which may be sugars. Chain branching can be introduced by including among the monomers a hydroxyalkyl monomer of formula:

$H_2C{=}CR^1CO_2R^3$ where $R^1$ is as specified above and $R^3$ is alkyl of 1 to 6 carbon atoms at least one hydroxy group, preferably 3 to 4 carbon atoms in a straight or branched chain and bearing a single hydroxy group. These monomers undergo a side reaction during the course of polymerisation, and this side reaction produces chain branching. When there is chain branching without cross-linking, it is suitable that a hydroxyalkyl monomer of the above formula provides from 10 to 40% by weight of the monomer mixture.

Suitable hydroxyalkyl monomers are hydroxypropyl methacrylate, hydroxybutylacrylate, and hydroxyethylacrylate.

A further suitable category of monomers (B) are esters of acrylic or methacrylic acids of formula:

$H_2C{=}CR^4CO_2R^5$ where $R^4$ is hydrogen or methyl and $R^5$ is a straight or branched alkyl of 9 to 16 carbon atoms.

These monomers may be used either singly, or in the form of a combination of two or more monomers.

Specific examples of suitable monomers of the aforementioned category include decyl (meth)acrylates, dodecyl (meth)acrylates, tetradecyl (meth)acrylates, and hexa-decyl (meth)acrylates.

The above-described monomers of category (B) may be combined with one or more further monomers which possess a polymerising unsaturated group, provided that the monomers of category (B) account for the main moiety and are present in not less than 50% by weight of the monomer mixture.

The further monomers which are effectively usable in combination with the monomers of category (B) include (meth)acrylates of monovalent aliphatic alcohols of not more than 9 carbon atoms such as methyl (meth)acrylates, ethyl (meth)acrylates, butyl (meth)acrylates, 2-ethylhexyl (meth)acrylates, and n-octyl (meth)acrylates; (meth)acrylates of monovalent aliphatic alcohols of not less than 17 carbon atoms' such as octadecyl (meth)acrylates and behenyl (meth)acrylates; (meth)acrylates of alicyclic alcohols such as cyclo-hexyl (meth)acrylates and menthyl(meth) acrylates; (meth)acrylates of phenols such as phenyl (meth) acrylates and octylphenyl (meth)acrylates; aminoalkyl (meth)acrylates such as dimethylaminoethyl (meth)acrylates and diethylaminoethyl (meth)acrylates; (meth)acrylates possessing a polyoxyethylene chain such as polyethylene glycol mono(meth)acrylates and methoxypolyethylene glycol mono(meth)acrylates; (meth)acrylamides such as (meth) acrylamides, N-methylol (meth)acrylamides, and dimethylaminoethyl (meth)acrylamides; polyolefins such as ethylene and propylene; aromatic vinyl compounds such as styrene, alfa-methyl styrene, and t-butyl styrene; and vinyl chloride, vinyl acetate, acrylonitrile, and (meth)acrylic acids, for example. These monomers may be used either singly, or in the form of a combination of two or more monomers.

Cross-linking between polymer chains formed from the above-mentioned monomers can be achieved by including greater than 0.001% to less than 10% by weight of a cross-linkable monomer having at least two carbon-carbon double bonds which functions as a cross-linking agent. Examples of suitable cross-linkable monomers for use with category (B) monomers include ethylene glycol di(meth) acrylates, diethylene glycol di(meth)acrylates, polyethylene glycol di(meth)acrylates, polyethylene glycol polypropylene glycol di(meth)acrylates, polypropylene glycol di(meth) acrylates, 1,3-butylene glycol di(meth)acrylates, N,N-propylene bis-acrylamide, diacrylamide dimethyl ether, N,N-methylene bis-acrylamide, glycerol di(meth)acrylates, neopentyl glycerol di(meth)acrylates, 1,6-hexane diol di(meth)acrylates, trimethylol propane tri(meth)acrylates, tetramethylol propane tetra(meth)acrylates, polyfunctional (meth)acrylates obtained by the esterification of alkylene oxide adducts of polyhydric alcohols (such as, for example, glycerine, neopentyl glycol, trimethylol propane, trimethylol ethane, and tetramethylol methane) with (meth)acrylic acids, and divinyl benzene, for example. These cross-linkable monomers may be used either singly, or in the form of a combination of two or more monomers.

The properties of the resulting cross-linked polymers obtained by reacting monomers of category (B) with a suitable cross-linkable monomer (or an optional further monomer as above described) and methods for their preparation, are described more fully in EP-A-441,512, incorporated herein by reference.

Optionally, a particle of swellable material may additionally comprise at the exterior of the core, a further polymer which incorporates free hydroxyl groups, as described more completely in WO 98/28398, incorporated herein by reference. Advantageously, the attachment of the polymer incorporating free hydroxyl groups to the core is such that the polymer is not completely removed upon contact of the particle with water. Therefore, under the appropriate conditions, the water-soluble encapsulation material typically dissolves and the polymer incorporating free hydroxyl groups serves to enhance deposition onto (or retention on) skin or surfaces such as vitreous surfaces or fabric. Typically, the further polymer which incorporates free hydroxyl groups is selected from polyvinyl alcohol, cellulose, or chemically modified cellulose.

Organic polymers comprising a monomer from either category (A) or (B) may be prepared using the technique of suspension polymerisation. This is a process in which the organic monomers are formed into a suspension in an aqueous phase, and polymerised. It is customary to stabilise the suspension by incorporating a stabilising agent in the aqueous phase before adding one or more monomers. Suitable stabilising agents include polyvinyl alcohol, anionic surfactants, or non-ionic surfactants with HLB of at least 8. Alternatively, the organic polymers may be formed by emulsion polymerisation which technique produces cores of approximately less than 1 micron which can be agglomerated to a desired size. Polymerisation of each suspended droplet leads to a bead of polymer. These techniques are more fully described in WO 98/28398, herein incorporated by reference.

According to another preferred embodiment, the perfume particles in the pouch comprise particles comprising encapsulation material. The materials used to form the wall are typically, and preferably, those used to form microcapsules by coacervation techniques. The materials are described in detail in the patents incorporated herein before by reference, e.g., U.S. Pat. Nos. 2,800,458; 3,159,585; 3,533,958; 3,697,437; 3,888,689; 3,996,156; 3,965,033; 4,010,038; and 4,016,098.

The preferred encapsulation material for perfumes that are to be incorporated into an aqueous low pH fabric softener composition containing cationic fabric softener is gelatin coacervated with a polyanion such as gum arabic and, preferably, cross-linked with glutaraldehyde. The preferred gelatin is Type A (acid precursor), preferably having a bloom strength of 300 or, less preferably, 275, then by increments of 25, down to the least preferred 150. A spray dried grade of gum arabic is preferred for purity. Although gelatin is always preferred, other polyanionic materials can be used in place of the gum arabic. Polyphosphates, alginates (preferably hydrolysed), carrageenan, carboxymethylcellulose, polyacrylates, silicates, pectin, Type B gelatin (at a pH where it is anionic), and mixtures thereof, can be used to replace the gum arabic, either in whole or in part, as the polyanionic material.

The gelatin/polyanion (preferably gum arabic) wall is preferably cross-linked. The preferred cross-linking material is glutaraldehyde. Other cross-linking agents such as urea/formaldehyde resins, tannin materials such as tannic acid, and mixtures thereof can be used to replace the glutaraldehyde either in whole or in part.

Another preferred encapsulation material comprises aminoplast polymers, which is an reaction product of an amine and an aldehyde, preferably an amine selected from melamine and urea and an aldehyde selected from formaldehyde, acetaldehyde and glutaraldehyde, and mixtures of said amines and said aldehydes. Particularly preferred are melamine/formaldehyde and urea/formaldehyde such as disclosed in EP397245, WO0149817, WO0151197, WO0104257.

According to yet another preferred embodiment, the perfume particles in the pouch comprise particles comprising a porous carrier e.g., a silica or a zeolite such as Zeolite X, Zeolite Y, and mixtures thereof. Particularly preferred porous carriers are particles with a nominal pore size of at least about 6 Angstroms to effectively incorporate perfume into their pores. Without wishing to be limited by theory, it is believed that these particles provide a channel or cage-like structure in which the perfume molecules are trapped. Unfortunately, such perfumed particles are not sufficiently storage-stable for commercial use in granular fabric care products such as laundry detergents, particularly due to premature release of perfume upon moisture absorption.

Preferred silicas include those mentioned in EP-A-332 259, EP-A-536 942, EP-A-820 762, WO97/08289 and WO-94/19449. Porous carrier material based on a polymeric matrix and method for the preparation of such particles include those described in EP-A-397245, EP-A-728 804, WO-94/19449, GB-2066839 and WO0209663.

One preferred porous carrier is a hydrophobic carrier particle having at least a pore volume of 0.1 ml/g consisting of pores with a diameter of 7 to 50 angstrom and having a perfume absorbed into said particle.

As used herein, hydrophobic carrier particle means a particle which passes a hydrophobicity test as hereinafter defined. The test is based on measuring the percentage of a perfume oil recovered from a perfumed carrier particle placed in salt solution. Hydrophobic particles tend not to release oil to the salt solution and typically have percentage recovery values of less than 5%. The test comprises adding 0.1 g of citral to 0.6 g of inorganic carrier with stirring until all of the perfume is absorbed. The particles are then allowed to equilibrate overnight in a sealed vial. The perfumed particles are then added to 5 ml of a 5% by weight $K_2CO_3$; solution of pH 10 stirred gently and left to stand for 5 minutes at room temperature. 5 ml of hexane are then added slowly to the surface of the salt solution and the hexane layer is stirred gently. 1 ml of the hexane is extracted and the concentration of citral in the hexane determined by UV analysis. The % recovery can then be calculated. Preferably, hydrophobic particles have percentage recovery values of less than 20%. For non-silica particles, such as alumina, it may be necessary to add 20 to 25 ml of isopropyl alcohol (IPA) per 100 ml of $K_2CO_3$; solution in order to assist with the wetting of the particles.

Suitable inorganic porous carriers for use in the present invention include aluminosilicates such as certain zeolites, clays, aluminas and silicas all with pore volume of at least 0.1 ml/g consisting of pores with a diameter between 7 and 50 angstrom which either have been thermally or chemically treated to render them hydrophobic or which by their nature are hydrophobic, such as high silica zeolites. Thermal treatment has been found to be preferred because the degree of hydrophobicity can be more easily kept to the level required for effective perfume delivery.

Preferably the porous carrier has a pore volume of at least 0.2 ml/g, most preferably between 0.1 ml/g and 1.5 ml/g consisting of pores with diameter of between 7 and 50 Å.

It was also found that when the perfumed carrier has a pore volume of at least 0.1 ml/g consisting of pores with a diameter between 7 and 50 angstrom the carrier can also function as a malodour absorber. Preferably the carrier has a pore volume of at least 0.1 ml/g consisting of pores with diameters between 20 and 40 angstrom.

The treatment can comprise heating the inorganic carrier at a temperature between 500° C. and 1000° C. for up to 3 hours. Precise temperatures and times are determined by the particular carrier used.

When a porous inorganic carrier has a pore volume of preferably 0.1 ml/g to 1.5 ml/g consisting of pores with a diameter of between 7 and 50 angstrom, the total pore volume of the carrier can be greater and include pores with a diameter greater than 50 angstrom. For example the total pore volume can be between 0.2 ml/g and 2.5 ml/g.

In the context of the present invention the porosity characteristics of a porous carrier are determined by nitrogen adsorption isotherm. The volume, Va, of nitrogen adsorbed in pores with diameters between 17 angstrom and 50 angstrom is determined according to the method of Barrett, Joyner and Halenda, "JACS", 73, 373, (1951), from the absorption data. The volume, Vb, of nitrogen absorbed in pores of between 7 angstrom and 20 angstrom in diameter is determined using T-plot analysis according to the method of Lippons and deBoer, "J Catalysis", 4, 319, (1965). V b is calculated from the intercept at t=0 of a line fitted to the linear portion of the t-plot curve within the range, t=3 to t=16A. If, within this range, there are two linear regions, the line with the lower gradient is used. If there are three linear regions the line is fitted to the one giving the lowest intercept at t=0. Inorganic carriers suitable for use in the present invention have a volume of Va plus Vb greater than 0.1 ml/g.

Inorganic porous carriers suitable for use in the present invention include silicas such as Gasil 200 also referred to as GASIL ex Crosfield Chemicals with a volume Va+Vb of 0.64 ml/g, an average particle size of 10–15 microns and a surface area of 730 $m^2/g$; Sorbsil ex Crosfield Chemicals with a volume Va+Vb of 0.69 ml/g, average particle size of 50–250 microns, and surface area of 730 $m^2/g$; Sorbsil C30 ex Crosfield Chem. with a volume of Va+V b of 0.98 ml/g particle size of 60 microns, and surface area of 640 ml/g and a conventional sodium zeolite Y ex Conteka with a volume Va+Vb of 0.37 ml/g, particle size of 5 microns and surface area of 690 $m^2/g$ and MD 263 a silica as described in Example 3 of EPO 287 232 with a volume Va+Vb of 0.28 ml/g, a surface area of 730 $m^2/g$ and a particle size of 25–30 microns, all of which can be treated to render them hydrophobic.

Preferred zeolites are selected from zeolite X, zeolite Y and mixtures thereof. The term "zeolite" used herein refers to a crystalline aluminosilicate material. The structural formula of a zeolite is based on the crystal unit cell, the smallest unit of structure represented by $Mm/n[(AlO_2)m(SiO_2)_y].xH_2O$ where n is the valence of the cation M, x is the number of water molecules per unit cell, in and y are the total number of tetrahedra per unit cell, and y/m is 1 to 100. Most preferably, y/m is 1 to 5. The cation M can be Group IA and Group IIA elements, such as sodium, potassium, magnesium, and calcium.

A zeolite useful herein is a faujasite-type zeolite, including Type X Zeolite or Type Y Zeolite, both with a pore size typically in the range of from about 4 to about 10 Angstrom units, preferably about 8 Angstrom units.

The aluminosilicate zeolite materials useful in the practice of this invention are commercially available. Methods for producing X and Y-type zeolites are well-known and available in standard texts. Preferred synthetic crystalline aluminosilicate materials useful herein are available under the designation Type X or Type Y. For purposes of illustration and not by way of limitation, in a preferred embodiment, the crystalline aluminosilicate material is Type X and/or Type Y as described by the formulas I to VI in WO 01/40430.

In yet another embodiment, the class of zeolites known as, "Zeolite MAP" may also be employed in the present invention. Such zeolites are disclosed and described in U.S. patent application Ser. No. 08/716,147 filed Sep. 16, 1996 and entitled, "Zeolite MAP and Alcalase for Improved Fabric Care."

The perfume particles used in the present invention have an average particle size from about 0.5 microns to about 120 microns, preferably from about 2 microns to about 30 microns. In the context of the present invention particle sizes are determined by a Malvern Mastersizer X particle analyser. For the purpose of this invention with particle size is meant 'volume weighted mean diameter' denoted by D[4,3] as described by M. Alderliesten in Part. Part. Syst. Charact., 7 (1990), 233–241. However, in some cases it may be desirable to agglomerate these perfume particles using a binder or other additives to give agglomerates of suitable size e.g., 100 to 2000 microns or more preferably 300 to 700 microns which then disintegrate into the smaller perfume particles in the wash liquor. In some cases the agglomerates may even be of from 0.1 to 30 mm.

The size of the perfume particles allows them to be entrained in surface of e.g., the fabrics with which they come in contact. Once established on the surface the particles can begin to release their incorporated perfume, especially when subjected to heat or humid conditions.

The perfume particles themselves need not be coated but in some cases additional coating may be desirable, for example to enable a slow release of the perfume after the wash. Any coating known in art may be suitable such as those described and referred to in WO 01/40430. Examples of other perfume particles suitable for use in the present invention include those described in EP0859828 (glassy coating materials), WO0140430 and WO0209663 (coatings on swollen perfume carriers).

Preferably, the perfume particles of the present invention have a hygroscopicity value of less than about 80%. The "hygroscopicity value", as used herein, means the level of moisture uptake by the particles, as measured by the percent increase in weight of the particles under the following test method. The hygroscopicity value required for the present invention particles is determined by placing 2 grams of particles in an open container petri dish under conditions of 90° F. and 80% relative humidity for a period of 4 weeks. The percent increase in weight of the particles at the end of this time is the particles' hygroscopicity value as used herein. Preferred particles of the present invention have a hygroscopicity value of less than about 50%, more preferably less than about 30%.

Cleaning Agents

Cleaning agents may be included in the pouch of the present invention. As can be appreciated for the present invention, these agents may be the same as or different from those agents which are typically used to formulate the remainder of the laundry and cleaning compositions used in combination with the pouch according to the present invention. Cleaning agents include detersive surfactants (especially soaps), builders, bleaching agents, enzymes, soil release polymers, dye transfer inhibitors, fillers and mixtures thereof. The exact type of cleaning agent will of course depend on the application. The skilled person may select a different surfactant for a skin care product than for a laundry product. Cleaning agent is meant to include care or other treatment agents such fabric softening or anti-wrinkle polymers in case of a laundry application. Cleaning agents may be incorporated into the perfume particles but will preferably be in a separate particle. In one preferred embodiment, the pouch comprising the perfume particles further contains a fabric care agent in a solid form, preferably 1–40%, more preferably 5 to 10% by weight of the total amount of solids in the pouch. The fabric care agent may be a cationic surfactant, a silicon compound, an anti-wrinkling agent, a fluorescer and mixtures thereof.

The total amount of perfume particles in the pouch may be between 5 mg and 10 g.

Preferably, the pouch contains less than 20% of a bleaching agent, preferably less than 5%, more preferably less than 1%, most preferably less than 0.1%, by weight of the total amount of solids in the pouch.

Preferably, the pouch contains less than 20% of anionic and nonionic surfactants, preferably less than 5%, more preferably less than 3%, most preferably less than 0.1% by weight of the total amount of solids in the pouch.

Cleaning and Care Compositions

The pouch comprising perfume particles of the present invention may of course be used in combination with a composition which may contain other ingredients. The compositions containing perfume particles can optionally include one or more other detersive ingredients (such defined below) or other materials for assisting or enhancing cleaning performance, treatment of the substrate to be cleaned, or to modify the aesthetics of the detergent composition (e.g., perfumes, colorants, dyes, etc.). The pouch comprising the perfume particles can be applied stand-alone as a unit dose, or in combination with a separate dose of a detergent composition.

Perfume

As used herein the term "perfume" is used to indicate any odoriferous material which is subsequently released into the aqueous bath and/or onto fabrics or other surfaces contacted therewith. The perfume will most often be liquid at ambient temperatures. A wide variety of chemicals are known for perfume uses, including materials such as aldehydes, especially C6–C14 aliphatic aldehydes, C6–C14 acyclic terpene aldehydes and mixtures thereof, ketones, alcohols and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Typical perfumes can comprise, for example, woody/earthy bases containing exotic materials such as sandalwood, civet and patchouli oil. The perfumes can be of a light floral fragrance, e.g., rose extract, violet extract, and lilac. The perfumes can also be formulated to provide desirable fruity odors, e.g., lime, lemon, and orange. Any chemically compatible material which exudes a pleasant or otherwise desirable odor can be used in the perfumed compositions herein.

If "sun dried" odor is the preferred odor, the perfume component is selected from the group consisting of C6–C14 aliphatic aldehydes, C6–C14 acyclic terpene aldehyde and mixtures thereof. Preferably, the perfume component is selected from C8–C12 aliphatic aldehydes, C8–C12 acyclic terpene aldehydes and mixtures thereof. Most preferably, the perfume component is selected from the group consisting of citral; neral; iso-citral; dihydro citral; citronellal; octanal; nonanal; decanal; undecanal; dodecanal; tridecanal; 2-methyl decanal; methyl nonyl acetaldehyde; 2-nonen-1-al; decanal; undecenal; undecylenic aldehyde; 2,6 dimethyl octanal; 2,6,10-trimethyl-9-undece-1-nal; trimethyl undecanal; dodecenal; melonal; 2-methyl octanal; 3, 5, 5, trimethyl hexanal and mixtures thereof. The preferable mixtures are, for example, a mixture comprising 30% by weight of 2-nonen-1-al, 40% by weight of undecylenic aldehyde and 30% by weight of citral or a mixture comprising 20% by weight of methyl nonyl acetaldehyde, 25% by weight of lauric aldehyde, 35% by weight of decanal and 20% by weight of 2-nonen-1-al.

By selecting a perfume component from among the foregoing, a "sun dried odor" is produced on the fabric even though the fabric is not actually dried in the sun. The "sun dried" odor is formed by selecting aldehydes such that at least one of them is present naturally in cotton fabrics after the fabric is dried in the sun and thus, are a component of the sun dried odor.

Perfumes may also include pro-fragrances such as acetal pro-fragrances, ketal pro-fragrances, ester pro-fragrances (e.g., digeranyl succinate), hydrolyzable inorganic-organic profragrances, and mixtures thereof. These pro-fragrances may release the perfume material as a result of simple hydrolysis, or may be pH-change-triggered pro-fragrances (e.g., pH drop) or may be enzymatically releasable pro-fragrances, or light releasable pro-fragrances.

Preferred perfume agents useful herein are defined as follows.

For purposes of the present invention, perfume agents are those which have the ability to be incorporated into the carrier, and hence their utility as components for delivery from the carrier through an aqueous environment. WO 98/41607 describes some characteristic physical parameters of perfume molecules which affect their ability to be incorporated into a carrier, such as into the pores of a zeolite.

Also preferred are perfumes carried through the laundry process and thereafter released into the air around the dried fabrics (e.g., such as the space around the fabric during storage). This requires movement of the perfume out of the zeolite pores with subsequent partitioning into the air around the fabric. Preferred perfume agents are therefore further identified on the basis of their volatility. Boiling point is used herein as a measure of volatility and preferred materials have a boiling point less than 300° C. Laundry agent perfume mixtures useful for the present invention perfume particles preferably comprise at least about 50% of deliverable agents with boiling point less than 300° C. (preferably at least about 60%; more preferably at least about 70%).

In addition, preferred perfume delivery particles herein for use in laundry detergents comprise compositions wherein at least about 80%, and more preferably at least about 90%, of the deliverable perfume agents have a weighted average C log P value ranging from about 1.0 to 16, and more preferably from about 2.0 to about 8.0. Most preferably, the deliverable perfume agents or mixtures have a weighted average C log P value between 3 and 4.5. While not wishing to be bound by theory, it is believed that perfume materials having the preferred C log P values are sufficiently hydrophobic to be held inside the pores of the carrier and deposited onto fabrics during the wash, yet are able to be released from the pores at a reasonable rate from dry fabric to provide a noticeable benefit. C log P values are obtained as follows.

Calculation of C log P:

These perfume ingredients are characterized by their octanol/water partition coefficient P. The octanol/water partition coefficient of a perfume ingredient is the ratio between its equilibrium concentration in octanol and in water. Since the partition coefficients of most perfume ingredients are large, they are more conveniently given in the form of their logarithm to the base 10, log P.

The log P of many perfume ingredients has been reported; for example, the Pomona92 database, available from Daylight Chemical Information Systems, Inc. (Daylight CIS), contains many, along with citations to the original literature.

However, the log P values are most conveniently calculated by the "C LOG P" program, also available from Daylight CIS. This program also lists experimental log P values when they are available in the Pomona92 database. The "calculated log P" (C log P) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990). The fragment approach is based on the chemical structure of each perfume ingredient and takes into account the numbers and types of atoms, the atom connectivity, and chemical bonding. The C log P values, which are the most reliable and widely used estimates for this physicochemical property, can be used instead of the experimental log P values in the selection of perfume ingredients.

Deposition of Perfume onto Surfaces

The method for depositing perfume onto a surface (preferably fabrics) comprises contacting the pouch comprising perfume particles according to the invention with an aqueous solution (which may be water) whereby the perfume particles are released into the solution thereby forming a wash liquor and contacting the surface with the thus formed wash liquor comprising preferably at least about 0.1 ppm of the perfume particle. When the pouch is used simultaneously with a cleaning composition the aqueous solution may further comprise at least about 100 ppm of cleaning agents. Preferably, said wash liquor comprises from about 10 ppm to about 200 ppm of the perfume particle and optionally from about 500 ppm to about 20,000 ppm of the conventional cleaning agents. Conventional cleaning agents include detersive surfactants (especially soaps), builders, bleaching agents, enzymes, soil release polymers, dye transfer inhibitors, fillers and mixtures thereof. The detersive agents may be added before, after or together with said pouch.

The perfume particles work is particularly useful for providing odor benefits during the laundering process and on wet and dry fabrics. The method comprises contacting fabrics with an aqueous liquor containing at least about 100 ppm of conventional detersive ingredients and at least about 1 ppm of the perfume particle such that the perfumed particles are entrained on the fabrics, storing line-dried fabrics under ambient conditions with humidity of at least 20%, drying the fabric in a conventional automatic dryer, or applying heat to fabrics which have been line-dried or machine dried at low heat (less than about 50° C. by conventional ironing means (preferably with steam or prewetting).

Mixing Perfume with Particles

As already stated, the particle comprises a particle carrier material and a perfume loaded into said carrier material. These two ingredients may be mixed in a number of different ways.

At laboratory scale, basic equipment used for this purpose can vary from a 10–20 g coffee grinder to a 100–500 g. food processor or even a 200–1000 g kitchen mixer. Procedure consists of placing the carrier material particles (zeolite or silica) in the equipment and pouring the perfume at the same time that mixing occurs. Mixing time is from 0.5 to 15 minutes. The loaded carrier material is then allowed to rest for a period from 0.5 to 48 hours before further processing. During the loading process when heating occurs, cool jacketing may be used as an option. At pilot plant level, suitable equipment is a mixer of the Littleford type, which is a batch type mixer with plows and chopper blades that operate at high RPM's, to continuously mix the powder or mixture of powders while liquid perfume oil is being sprayed thereon.

When the Type X or Type Y Zeolites are used as the carrier herein, they preferably contain less than about 15% desorbable water, more preferably less than about 8% desorbable water, and most preferably less than about 5% desorbable water. Such materials may be obtained by first activating/dehydrating by heating to about 150 to 350° C., optionally with reduced pressure (from about 0.001 to about 20 Torr). After activation, the agent is slowly and thoroughly mixed with the activated zeolite and, optionally, heated to about 60° C. or up to about 2 hours to accelerate absorption equilibrium within the zeolite particles. The perfume/zeolite mixture is then cooled to room temperature and is in the form of a free-flowing powder.

The amount of perfume incorporated into the perfume particle is typically from 1% to 90%, preferably at least about 10%, more preferably at least about 18.5%, by weight of the loaded particle, when a porous carrier is used as particle material, the amount of perfume incorporated into the carrier is typically from 1% to 40%, preferably at least about 10%, more preferably at least about 18.5%, by weight of the loaded particle, given the limits on the pore volume of the porous carrier.

Water-Reactive Material

The pouch is made from a water-reactive material. For the purpose of the invention, water-reactive material means material which either dissolves, ruptures, disperses or disintegrates (or mixtures thereof) upon contact with water, releasing thereby the composition. Preferably, the material is water-soluble.

In one preferred embodiment, the water reactive material is such that the pouch comprising the perfume particles releases its content during the rinse cycle. This is possible by incorporating a trigger into the water reactive material known in the art such as described in U.S. Pat. No. 4,765,916.

The pouch is preferably made from a water-soluble film, said water-soluble film having a solubility in water of at least 50%, preferably at least 75% or even at least 95%, as measured by the gravimetric method set out hereinafter using a glass-filter with a maximum pore size of 50 microns. The water-soluble film can be single layer or multilayer, i.e., two, three or more layers. Each layer may be of a different composition to tailor the solubility and stability characteristics of the total film.

Gravimetric method for determining water-solubility of the material of the pouch:

10 grams±0.1 gram of material is added in a 400 ml beaker, whereof the weight has been determined, and 245 ml±1 ml of distilled water is added. This is stirred vigorously on magnetic stirrer set at 600 rpm, for 30 minutes at 25° C. Then, the mixture is filtered through a folded qualitative sintered-glass filter with the pore sizes as defined above (max. 50 micron). The water is dried off from the collected filtrate by any conventional method, and the weight of the remaining polymer is determined (which is the dissolved or dispersed fraction). Then, the % solubility or dispersability can be calculated.

Preferred materials are films of polymeric materials, e.g. polymers or co-polymers which are formed into a film or sheet. For the purpose of this invention co-polymers include polymers made from 2 or more co-monomers. The film can for example be obtained by solvent casting, blow-moulding, extrusion (casting) or blow extrusion of the polymer material, as known in the art. One preferred method is aqueous casting. Preferred polymers, copolymers or derivatives thereof are selected from polyvinyl alcohols, polyvinyl pyrrolidone, polyalkylene oxides, cellulose, cellulose ethers, polyvinyl acetates and acetals, polycarboxylic acids and salts, proteins, polyamides, polyacrylates, polymethacrylates, polysaccharides, resins, gums such as xanthum and carrageen and mixtures thereof. More preferably the polymers, copolymers or derivatives thereof are selected from polyvinyl alcohols, polyvinyl pyrrolidone, polyalkylene oxides, cellulose ethers, polyacrylates and water-soluble acrylate copolymers, methylcellulose, carboxymethylcellulose sodium, ethylcellulose, hydroxyethyl cellulose, hydroxypropyl methylcellulose, polymethacrylates, gelatin, most preferably polyvinyl alcohols, polyvinyl alcohol copolymers and hydroxypropyl methyl cellulose (HPMC) and mixtures thereof. The polymer can have any weight average molecular weight, preferably from about 1000 to 1,000,000, or even from 10,000 to 300,000 or even form 15,000 to 200,000 or even form 20,000 to 150,000. Preferred polyvinyl alcohols have weight average molecular weight of 10,000 to 200,000 or more preferably 50,000 to 150,000.

Mixtures of polymers can also be used. This may in particular be beneficial to control the mechanical and/or dissolution properties of the compartments or pouch, depending on the application thereof and the required needs. For example, it may be preferred that one polymer material has a higher water-solubility than another polymer material, and/or one polymer material has a higher mechanical strength than another polymer material. It may be preferred that a mixture of polymers is used, having different weight average molecular weights, for example a mixture of polyvinyl alcohol (PVA) or a copolymer thereof of a weight average molecular weight of 10,000–40,000, preferably around 20,000, and of PVA or copolymer thereof, with a weight average molecular weight of about 100,000 to 300,000, preferably around 150,000.

Also useful are polymer blend compositions, for example comprising a hydrolytically degradable and water-soluble polymer blend such as polylactide and polyvinyl alcohol, achieved by the mixing of polylactide and polyvinyl alcohol, typically comprising 1–35% by weight polylactide and approximately from 65% to 99% by weight polyvinyl alcohol, if the material is to be water-soluble.

It may be preferred that the polymer present in the film is from 60% to 98% hydrolysed, preferably 80% to 90%, to improve the dissolution of the material, and/or that the levels of plasticiser, including water, in the film are varied such that the dissolution is adjusted as required.

Most preferred is PVA film; preferably, the level of polymer in the film, for example a PVA polymer, is at least 60%. Such films typically comprise a PVA polymer with similar properties to the film known under the trade reference M8630, as sold by Monosol of Portage, Ind., US. Preferably, the pouch is made of a film material having the properties of PVA polymer-containing film M8630. Even more preferred is the material M8630 itself. Other highly preferred PVA films useful herein are also available as "Solublon PT30" and "Solublon KA40" from Aicello Chemical Co., Ltd., Aichi, Japan.

The film herein may comprise other additive ingredients such as plasticisers (for example water glycerol, ethylene glycol, diethyleneglycol, propylene glycol, sorbitol and mixtures thereof), stabilisers, disintegrating aids, etc.

Preferably, the pouch is made of a material which is stretchable, as set out herein. This facilitates the closure of the open pouch, when is filled for more than 90% or even 95% by volume or even 100% or even over filled. Moreover, the material is preferably elastic, to ensure tight packing and fixation of the composition therein during handling, e.g. to ensure no (additional) head space can be form after closure of the compartment. Preferred stretchable materials have a maximum stretching degree of at least 150%, as determined by comparison of the original length of a piece of material just prior to rupture due to stretching, when a force of from about 1 to about 35 Newtons is applied to a piece of film with a width of 1 cm. Preferably, the material is such that it has a stretching degree as before, when a force of from about 2 to about 30 Newtons, and more preferably from about 10 to about 25 Newtons is used. For example, a piece of film with a length of 10 cm and a width of 1 cm and a thickness of 40 microns is stretched lengthwise with an increasing stress, up to the point that it ruptures. When the film is water sensitive, the film is preferably equilibrated to standard relative humidity e.g., 50%. The extent of elongation just before rupture can be determined by continuously measuring the length and the degree of stretching can be calculated. For example, a piece of film with an original length of 10 cm. which is stretched with a force of 9.2 Newton to 52 cm just before breaking, has a-maximum stretching degree of 520%.

The force to stretch such a piece of film (10 cm×1 cm,×40 microns) to a degree of 200% should preferably be within the ranges described above. This in particular ensures that the elastic force remaining in the film after forming the pouch or closing the pouch is high enough to pack the composition tightly within the pouch (but not so high that the film cannot be drawn into a vacuum mould of reasonable depth, when the pouch is made by a process involving the use of vacuum, such as by vacuum-forming or thermo-forming).

As is clear form the definition herein, the stretchable material is defined by a degree of stretching measured when it is not present as a closed pouch. However, as said above, the material is preferably stretched when forming or closing the pouch. This can for example been seen by printing a grid onto the material, e.g. film, prior to stretching, then forming a pouch; it can be seen that squares of the grid are elongated and thus stretched.

The elasticity of the stretchable material can be defined as the 'elasticity recovery'. This can be determined by stretching the material for example to an elongation of 200%, as set out above, and measuring the length of the material after release of the stretching force. For example a piece of film of a length of 10 cm and width 1 cm. and thickness of 40 microns is stretched lengthways to 20 cm (200% elongation) with a force of 2.8 Newtons (as above), and then the force is removed. The film snaps back to a length of 12 cm, which indicates an 80% elastic recovery. Preferably, the pouch material has an elasticity recovery of from about 20% to about 100%, more preferably from about 50% to about 100%, even more preferably from about 60% to about 100%, still more preferably from about 75% to about 100%, and even still more preferably form about 80% to about 100%.

Typically and preferably, the degree of stretching is non-uniform over the pouch, due to the formation and closing process. For example, when a film is positioned in a mould and an open pouch is formed by vacuum forming, the part of the film in the bottom of the mould, furthest removed form the points of closing, will be stretched more than in the top part. Another advantage of using stretchable and preferably also elastic material, is that the stretching action stretches the material non-uniformly, which results in a pouch which has a non-uniform thickness. This allows control of the dissolution/disintegration or dispersion of the pouches herein. Preferably, the material is stretched such that the thickness variation in the pouch formed of the stretched material is from 10 to 1000%, preferably 20% to 600%, or even 40% to 500% or even 60% to 400%. This can be measured by any method, for example by use of an appropriate micrometer.

Method of Preparation

The sachets or pouches can be made by any technique familiar to a person skilled in the art such as vertical form fill seal, horizontal form fill seal and thermoforming fill seal methods. Sealing can be achieved using heat, solvent, ultrasound or other techniques typically used for making sachets. When the pouch is a capsule it can be made using a suitable technology such as rotary die technology.

All percentages, ratios and proportions herein are on a weight basis unless otherwise indicated. All documents cited herein are hereby incorporated by reference. Other than in the examples, or where otherwise indicated, all numbers expressing quantities of ingredients or reaction conditions used herein are to be understood as modified in all instances by the term "about". Similarly, all percentages are weight/weight percentages of the perfume particles unless otherwise indicated. Where the term "comprising" is used in the specification or claims, it is not intended to exclude any terms, steps or features not specifically recited. When a range is given in the format from x to y this is meant to include the endpoints. When more than one range is preferred for an integer, this includes all ranges subsumed therein. For example when for an integer ranges 1 to 90 and 5 to 70 this meant to includes the ranges 1 to 70 and 5 to 90.

The invention is more fully illustrated by the following non-limiting examples showing some preferred embodiments of the invention.

EXAMPLE

Perfumed silica particles were made by thoroughly mixing 1 part of perfume and 4 parts of silica with a glass rod in a glass beaker. A 3 cm by 3 cm sachet was prepared from a commercially available 60 micron polyvinyl alcohol film (M4045 or M8630) from Monosol by folding a piece of the film and sealing its three sides with an impulse heat sealer. Before sealing the final seal, 1 g of perfumed loaded silica particles were introduced into the sachet. The sachet and silica particles were then subjected to an accelerated storage test for 4 weeks at 37° C. and 70% RH. Another sachet was left dipped in a non-aqueous liquid detergent. The detergent was placed in a closed glass jar that was left at 37° C.

Perfume left inside silica was determined by extraction of the silica using ethanol and injecting an aliquot of the extract into a gas chromatograph equipped with a mass spectrometer as the detector. The pouches were opened first and then the silica extracted. A blank reading was obtained by quantifying perfume in freshly made perfume loaded-silica using the above method. Results of the storage test are tabulated below.

| | Perfume remaining (%) | | |
|---|---|---|---|
| | In free silica | Silica in pouch | Silica in pouch (Pouch itself was stored in a container with a liquid detergent composition) |
| After 4 weeks | 0.1 | 83 | 77 |

It is clear that a substantial improvement is obtained in terms of lower perfume loss when the silica is present in a pouch.

The invention claimed is:

1. A pouch made of water-reactive material comprising solids wherein more than 10% by weight of the total amount of solids in the pouch are perfume particles, wherein the pouch contains less than 3% of anionic and nonionic surfactants by weight of the total amount of solids in the pouch; and wherein said perfume particles comprises particle carrier material selected from polymers comprising monomers selected from isobutyl methacrylate, n-butyl acrylate, n-butyl methacrylate, isobutyl acrylate, n-propyl acrylate isopropylmethacrylate, methyl methacrylate, decyl (meth)acrylates, dodecyl (meth)acrylates, tetradecyl (meth)acrylates, hexa-decyl (meth)acrylates, and mixtures thereof.

2. A pouch according to claim 1 wherein the pouch contains less than 20% of a bleaching agent by weight of the total amount of solids in the pouch.

3. A pouch according to claim 1 wherein said perfume particles comprises a particle having at least a pore volume of 0.1 ml/g consisting of pores with a diameter of 7 to 50 angstrom.

4. A pouch according to claim 1 wherein said perfume particle comprises an amount of perfume from 1% to 90% by weight of the loaded particle.

5. A pouch according to claim 1 wherein said water reactive material of said pouch comprises polymers, copolymers or derivatives thereof selected from polyvinyl alcohols, polyvinyl pyrrolidone, polyalkylene oxides, cellulose, cellulose ethers, polyvinyl acetates and acetals, polycarboxylic acids and salts, proteins, polyamides, polyacrylates, polymethacrylates, polysaceharides, resins, gums and mixtures thereof.

6. A method for improving the storage stability of perfume particles comprising the steps of forming a pouch of a water-reactive film in an open form, adding multiple perfume particles into said pouch, sealing said pouch to close it, wherein the pouch is according to claim 1.

7. A method for depositing perfume onto a surface comprises contacting the pouch comprising perfume particles according to claim 1 with an aqueous solution whereby the perfume particles are released into the solution thereby forming a wash liquor and contacting the surface with the thus formed wash liquor comprising preferably at least about 0.1 ppm of the perfume particle.

* * * * *